US005615623A

United States Patent [19]

Capraro, Jr.

[11] Patent Number: 5,615,623

[45] Date of Patent: Apr. 1, 1997

[54] FRONT ACCESS AUTOMATIC TELLER MACHINE SECURITY ENCLOSURE

[76] Inventor: Anthony Capraro, Jr., 178 Pierce St., Staten Island, N.Y. 10304

[21] Appl. No.: 574,637

[22] Filed: Dec. 19, 1995

[51] Int. Cl.[6] ..... E06B 9/00

[52] U.S. Cl. ..... 109/2; 52/36.1; 52/67; 109/24.1; 109/47; 109/49.5; 109/70; 902/34

[58] Field of Search ..... 109/24, 65, 71, 109/45–49, 2, 24.1, 49.5, 69, 70, 73; 52/67, 36.1; 902/34

[56] References Cited

U.S. PATENT DOCUMENTS

| | | | |
|---|---|---|---|
| 1,184,094 | 5/1916 | Harrington, Jr. | 109/79 |
| 4,179,723 | 12/1979 | Spencer | 109/24.1 X |
| 4,399,755 | 8/1983 | Wiedmann | 109/2 |
| 4,497,261 | 2/1985 | Ferris et al. | 109/2 |
| 4,513,670 | 4/1985 | Berman | 109/24.1 |
| 4,557,352 | 12/1985 | Tschappat, Jr. | 109/2 X |
| 4,558,650 | 12/1985 | Berman | 109/24.1 |
| 4,577,562 | 3/1986 | Berman | 52/67 X |
| 4,681,044 | 7/1987 | Dallman | 109/24.1 |
| 4,696,239 | 9/1987 | Trucksess | 109/24.1 |
| 4,813,475 | 3/1989 | Couvrette | 109/2 X |
| 4,884,514 | 12/1989 | Shockey et al. | 109/24.1 |
| 4,911,087 | 3/1990 | Couvrette | 109/2 X |
| 5,036,779 | 8/1991 | Capraro | 109/24.1 |
| 5,222,445 | 6/1993 | Capraro | 109/2 |

*Primary Examiner*—Lloyd A. Gall
*Attorney, Agent, or Firm*—Richard L. Miller, P. E.

[57] ABSTRACT

A front access automatic teller machine security enclosure that includes a hollow parallelepiped-shaped rear portion, a hollow parallelepiped-shaped front portion, a service door, and a security shield. The front portion is smaller than the rear portion and is in telescopic communication therewith. The front portion has an extended position where it is fully extended from the rear portion and a retracted position where it is fully retracted in the rear portion. When the front portion is in the extended position the service door can be opened and the front access automatic teller machine can be serviced. When the front portion is in the retracted position the service door can not be opened. When the front portion is in the retracted position the security shield of the front of the hollow parallelepiped-shaped front portion is clear of the aperture of the front wall of the front portion and the front access automatic teller machine enters the aperture and is accessible by a customer. When the front portion is in the extended position the front access automatic teller machine, that is disposed in the rear portion, does not enter the aperture of the front wall of the front portion and is therefore not accessible by a customer and the security shield can close the aperture of the front wall of the front portion.

18 Claims, 4 Drawing Sheets

FRONT ACCESS AUTOMATIC TELLER MACHINE SECURITY ENCLOSURE

BACKGROUND OF THE INVENTION

The present invention relates to a front access automatic teller machine security enclosure. More particularly, the present invention relates to a front access automatic teller machine security enclosure that includes a hollow parallelepiped-shaped rear portion, a hollow parallelepiped-shaped front portion, a service door, and a security shield.

Automatic unmanned teller machines are common in today's society. Such machines are commonly located away from the principal banking offices, such as in lobbies, airports, shopping centers or installed in and accessible from an outside wall of a bank building. Most of such machined have 24 hour walk-up or drive-up availability, and the machines must be secure from access by unauthorized persons both from the outside where the authorized banking is performed by the public and from the inside where the mechanisms of the machine and usually cash are located.

In addition to availability and security, another factor in the location of such machines is that they take up as little space as possible. When installed on an outside wall of a bank building it is important that the machine be accessible for servicing, but if its security enclosure extends too far into the banking premises, it takes away from room otherwise available for bank workers. When the machine is being serviced it is also necessary that such servicing take place in a secure environment.

Some models of automatic teller machines require front access to load with cash. Some examples of such are the Interbold ATM units and the NCR ATM units. Logistics sometimes require that the automatic teller machine be placed up against a back wall.

Numerous innovations for automatic teller machine enclosures have been provided in the prior art that will be described. However, even though these innovations may be suitable for the specific individual purposes to which they address, they differ from the present invention in that they do not teach a front access automatic teller machine security enclosure that includes a hollow parallelepiped-shaped rear portion, a hollow parallelepiped-shaped front portion, a service door, and a security shield.

FOR EXAMPLE, U.S. Pat. No. 4,497,261 to Ferris et al. teaches a security enclosure for an automatic teller machine that includes a hollow building for housing an automatic teller machine and an indexing turntable mechanism for accessing the automatic teller machine contained therein.

ANOTHER EXAMPLE, U.S. Pat. No. 4,558,650 to Berman teaches an automatic teller machine enclosure that includes a secure front panel and an operable rear panel. An automatic teller machine is mountable on a rotating base disposed at a cutout in the front panel. A horizontally slidable shield closes the cutout in the front panel.

STILL ANOTHER EXAMPLE, U.S. Pat. No. 4,696,239 to Trucksess teaches a security enclosure for a transaction machine that includes a housing with a window. An apparatus automatically moves an automatic teller machine back from the window of the housing while simultaneously turning the automatic teller machine so that when the automatic teller machine is rotated it blocks the window in the housing.

YET ANOTHER EXAMPLE, U.S. Pat. No. 4,884,514 to Shockey et al. teaches an automatic teller machine housing that has a cutout and includes a conventional automatic teller machine that has a money cassette portion, internal mechanical and electrical components and a display portion exposed in the cutout in the housing. The money cassette portion is rotatively and slidably mounted within a vault within the housing and assumes an operating position and a loading position. A turntable that has a slidable platform mounted thereon orientates the money cassette through the operating and loading positions.

STILL YET ANOTHER EXAMPLE, U.S. Pat. No. 5,036,779 to Capraro teaches an automatic teller machine enclosure that includes a front portion that houses an automatic teller machine.

The front portion has an open rear wall and a front wall with a cutout for exposing the customer operable part of the automatic teller machine. A rear portion that has an open front wall is slidably mounted in the front portion and has a side wall with a door.

FINALLY, YET STILL ANOTHER EXAMPLE, U.S. Pat. No. 5,222,445 to Capraro teaches a maintenance enclosure for an automatic teller machine that includes stationary portion disposed about three sides of the automatic teller machine with an open front. An expandable enclosure allows a service panel to selectively close the open front of stationary portion.

It is apparent that numerous innovations for automatic teller machine enclosures have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a front access automatic teller machine security enclosure that avoids the disadvantages of the prior art.

ANOTHER OBJECT of the present invention is to provide a front access automatic teller machine security enclosure that is simple and inexpensive to manufacture.

STILL ANOTHER OBJECT of the present invention is to provide a front access automatic teller machine security enclosure that is simple to use.

YET ANOTHER OBJECT of the present invention is to provide a front access automatic teller machine security enclosure that is modular.

STILL YET ANOTHER OBJECT of the present invention is to provide a front access automatic teller machine security enclosure that gives the buyer the option to keep the enclosure in a permanent location or to disassemble it and relocate it to another locale.

YET STILL ANOTHER OBJECT of the present invention is to provide a front access automatic teller machine security enclosure that can be used on the interior or on the exterior of a structure.

STILL YET ANOTHER OBJECT of the present invention is to provide a front access automatic teller machine security enclosure that is specifically designed to accommodate a front access loading automatic teller machine unit.

YET STILL ANOTHER OBJECT of the present invention is to provide a front access automatic teller machine security enclosure that can accommodate either Interbold ATM units or NCR ATM units.

STILL YET ANOTHER OBJECT of the present invention is to provide a front access automatic teller machine security enclosure that can be placed against a wall, in a vestibule, or be free standing.

BRIEFLY STATED, YET STILL ANOTHER OBJECT of the present invention is to provide a front access automatic teller machine security enclosure that includes a hollow parallelepiped-shaped rear portion, a hollow parallelepiped-shaped front portion, a service door, and a security shield.

STILL YET ANOTHER OBJECT of the present invention is to provide a front access automatic teller machine security enclosure wherein the hollow parallelepiped-shaped rear portion positions a front access automatic teller machine therein.

YET STILL ANOTHER OBJECT of the present invention is to provide a front access automatic teller machine security enclosure wherein the hollow parallelepiped-shaped rear portion has a top with an aperture, a pair of side walls, a back wall, a bottom, and a substantially open front wall.

STILL YET ANOTHER OBJECT of the present invention is to provide a front access automatic teller machine security enclosure wherein the hollow parallelepiped-shaped front portion is smaller than the hollow parallelepiped-shaped rear portion and is in telescopic communication with the hollow parallelepiped-shaped rear portion through the substantially open front wall of the hollow parallelepiped-shaped rear portion.

YET STILL ANOTHER OBJECT of the present invention is to provide a front access automatic teller machine security enclosure wherein the hollow parallelepiped-shaped front portion has a top with an aperture, a pair of side walls one of which having an aperture, an open back wall, a bottom, and a front wall with an aperture.

STILL YET ANOTHER OBJECT of the present invention is to provide a front access automatic teller machine security enclosure wherein the hollow parallelepiped-shaped front portion having an extended position where the hollow parallelepiped-shaped front portion is fully extended from the hollow parallelepiped-shaped rear portion and a retracted position where the hollow parallelepiped-shaped front portion is fully retracted into the hollow parallelepiped-shaped rear portion.

YET STILL ANOTHER OBJECT of the present invention is to provide a front access automatic teller machine security enclosure wherein the service door is hingedly mounted flush to the one of the pair of side walls that has the aperture of the hollow parallelepiped-shaped front portion.

STILL YET ANOTHER OBJECT of the present invention is to provide a front access automatic teller machine security enclosure wherein the service door of the one of the pair of side walls opens and closes the aperture of the one of the pair of side walls of the hollow parallelepiped-shaped front portion.

YET STILL ANOTHER OBJECT of the present invention is to provide a front access automatic teller machine security enclosure wherein when the hollow parallelepiped-shaped front portion is in the extended position the service door of the one of the pair of side walls of the hollow parallelepiped-shaped front portion can be opened and the front access automatic teller machine can be serviced.

STILL YET ANOTHER OBJECT of the present invention is to provide a front access automatic teller machine security enclosure wherein when the hollow parallelepiped-shaped front portion is in the retracted position the service door of the one of the pair of side walls of the hollow parallelepiped-shaped front portion can not be opened.

YET STILL ANOTHER OBJECT of the present invention is to provide a front access automatic teller machine security enclosure wherein the security shield is movably mounted to the front wall of the hollow parallelepiped-shaped front portion and opens and closes the aperture of the front wall of the hollow parallelepiped-shaped front portion.

STILL YET ANOTHER OBJECT of the present invention is to provide a front access automatic teller machine security enclosure wherein when the hollow parallelepiped-shaped front portion is in the retracted position the security shield of the front of the hollow parallelepiped-shaped front portion is clear of the aperture of the front wall of the hollow parallelepiped-shaped front portion and the front access automatic teller machine enters the aperture of the front wall of the hollow parallelepiped-shaped front portion and is accessible by a customer.

YET STILL ANOTHER OBJECT of the present invention is to provide a front access automatic teller machine security enclosure wherein when the hollow parallelepiped-shaped front portion is in the extended position the security shield of the front wall of the hollow parallelepiped-shaped front portion can cover the aperture of the front wall of the hollow parallelepiped-shaped front portion and the front access automatic teller machine does not enter the aperture of the front wall of the hollow parallelepiped-shaped front portion and is therefore not accessible by a customer.

STILL YET ANOTHER OBJECT of the present invention is to provide a front access automatic teller machine security enclosure wherein the hollow parallelepiped-shaped rear portion and the hollow parallelepiped-shaped front portion are modular, so that the automatic teller machine security enclosure can be disassembled and relocated to another location.

YET STILL ANOTHER OBJECT of the present invention is to provide a front access automatic teller machine security enclosure wherein the hollow parallelepiped-shaped front portion is narrower than the hollow parallelepiped-shaped rear portion, so that the hollow parallelepiped-shaped front portion fits within the hollow parallelepiped-shaped rear portion except for the front wall of the hollow parallelepiped-shaped front portion which extends on both sides beyond the point where the front wall of the hollow parallelepiped-shaped front portion attaches to the pair of side walls of the hollow parallelepiped-shaped front portion.

STILL YET ANOTHER OBJECT of the present invention is to provide a front access automatic teller machine security enclosure wherein the front wall of the hollow parallelepiped-shaped front portion which extends on both sides beyond the point where the front wall of the hollow parallelepiped-shaped front portion attaches to the pair of side walls of the hollow parallelepiped-shaped front portion, abuts the foremost parts of the pair of sidewalls of the hollow parallelepiped-shaped rear portion, so that when the hollow parallelepiped-shaped front portion is fully retracted into the hollow parallelepiped-shaped rear portion an entirely closed and secure configuration for the front access automatic teller machine security enclosure is provided.

YET STILL ANOTHER OBJECT of the present invention is to provide a front access automatic teller machine security enclosure wherein the service door of the one of the pair of side walls of the hollow parallelepiped-shaped front portion has a peep hole and a door pull, so that the opening of the service door of the one of the pair of side walls of the hollow parallelepiped-shaped front portion can be facilitated.

STILL YET ANOTHER OBJECT of the present invention is to provide a front access automatic teller machine security enclosure that further includes front portion casters that are mounted on a front portion L-shaped bracket which is bolted to a front portion inner support wall which is attached to a lateral frame which is attached to the bottom of the front wall of the hollow parallelepiped-shaped front portion, so that the hollow parallelepiped-shaped front portion can be readily moved into and out of the hollow parallelepiped-shaped rear portion.

YET STILL ANOTHER OBJECT of the present invention is to provide a front access automatic teller machine security enclosure that further includes a pair of full extension slide members attached to the top and bottom of the inside of each of the pair of sidewalls of the hollow parallelepiped-shaped rear portion and are matingly attached to the top and bottom of the outside of each of the pair of side walls of the hollow parallelepiped-shaped front portion, so that the hollow parallelepiped-shaped front portion can be smoothly moved into and out of the hollow parallelepiped-shaped rear portion.

STILL YET ANOTHER OBJECT of the present invention is to provide a front access automatic teller machine security enclosure that further includes adjustable leveling feet mounted to the rear of the outside of the bottom of the hollow parallelepiped-shaped rear portion, so that the front access automatic teller machine security enclosure can be properly leveled.

YET STILL ANOTHER OBJECT of the present invention is to provide a front access automatic teller machine security enclosure wherein the exterior of the front access automatic teller machine security enclosure is a material selected from the group consisting of wood, laminate composite material, and structurally ribbed and insulated metal, so that numerous moves of the front access automatic teller machine security enclosure and the forces exerted by the extension and retraction of the hollow parallelepiped-shaped front portion can be withstood while resisting attempts to enter the front access automatic teller machine security enclosure by unauthorized people.

STILL YET ANOTHER OBJECT of the present invention is to provide a front access automatic teller machine security enclosure that further includes a dead lock arrangement so as to secure the hollow parallelepiped-shaped front portion to the hollow parallelepiped-shaped rear portion, so that unauthorized entry into the front access automatic teller machine security enclosure is prevented.

YET STILL ANOTHER OBJECT of the present invention is to provide a front access automatic teller machine security enclosure wherein the dead bolt lock arrangement includes a dead bolt that is attached within an extension of the front wall of the hollow parallelepiped-shaped front portion that engages a clasp attached to one of the pair of sidewalls of the hollow parallelepiped-shaped rear portion, adjacent to the front wall of the hollow parallelepiped-shaped front portion.

STILL YET ANOTHER OBJECT of the present invention is to provide a front access automatic teller machine security enclosure that further includes a bullet catch, so that the service door of one of the pair of side walls of the hollow parallelepiped-shaped front portion is maintained closed until unlatched.

YET STILL ANOTHER OBJECT of the present invention is to provide a front access automatic teller machine security enclosure that further includes recessed hand pulls that are attached at a convenient height on the front wall of the hollow parallelepiped-shaped front portion adjacent the aperture of the front of the hollow parallelepiped-shaped front portion, so that one person can conveniently pull out the hollow parallelepiped-shaped front portion from the hollow parallelepiped-shaped rear portion.

STILL YET ANOTHER OBJECT of the present invention is to provide a front access automatic teller machine security enclosure wherein the front wall of the hollow parallelepiped-shaped front portion further has a curved facade that is disposed above, and curves into, the aperture of the front wall of the hollow parallelepiped-shaped front portion.

YET STILL ANOTHER OBJECT of the present invention is to provide a front access automatic teller machine security enclosure wherein the security shield of the front wall of the hollow parallelepiped-shaped front portion is movable relative to the curved facade of the front wall of the hollow parallelepiped-shaped front portion by means selected from the group consisting of pulled down from the inside of the curved facade of the front wall of the hollow parallelepiped-shaped front portion by tracks, and pivoted down from the bottom of the curved facade of the front wall of the hollow parallelepiped-shaped front portion by a piano hinge, so that the aperture of the front wall of the hollow parallelepiped-shaped front portion can be conveniently closed.

STILL YET ANOTHER OBJECT of the present invention is to provide a front access automatic teller machine security enclosure that further includes a pair of steel pegs, so that the security shield of the front wall of the hollow parallelepiped-shaped front portion can be locked to the front wall of the hollow parallelepiped-shaped front portion.

YET STILL ANOTHER OBJECT of the present invention is to provide a front access automatic teller machine security enclosure that further includes a cabinet disposed in the hollow parallelepiped-shaped rear portion, so that the front access automatic teller machine can be supported thereon.

STILL YET ANOTHER OBJECT of the present invention is to provide a front access automatic teller machine security enclosure that further includes a wire mesh grille disposed in the aperture of the top of the hollow parallelepiped-shaped front portion immediately beneath the aperture of the top of the hollow parallelepiped-shaped rear portion, a pipe that extends completely through the aperture of the top of the hollow parallelepiped-shaped rear portion, and an exhaust fan disposed in the pipe, so that heat generated by the front access automatic teller machine can escape from the front access automatic teller machine security enclosure.

YET STILL ANOTHER OBJECT of the present invention is to provide a front access automatic teller machine security enclosure that further includes vertically disposed quarter round pieces disposed where with the front wall of the hollow parallelepiped-shaped front portion connects to the pair of side walls of the hollow parallelepiped-shaped front portion, so that the front access automatic teller machine security enclosure has added support and a finished appearance.

FINALLY, STILL YET ANOTHER OBJECT of the present invention is to provide a front access automatic teller machine security enclosure that further includes a telephone that is recessed in the front wall of the hollow parallelepiped-shaped front portion to one side of the front access automatic teller machine.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
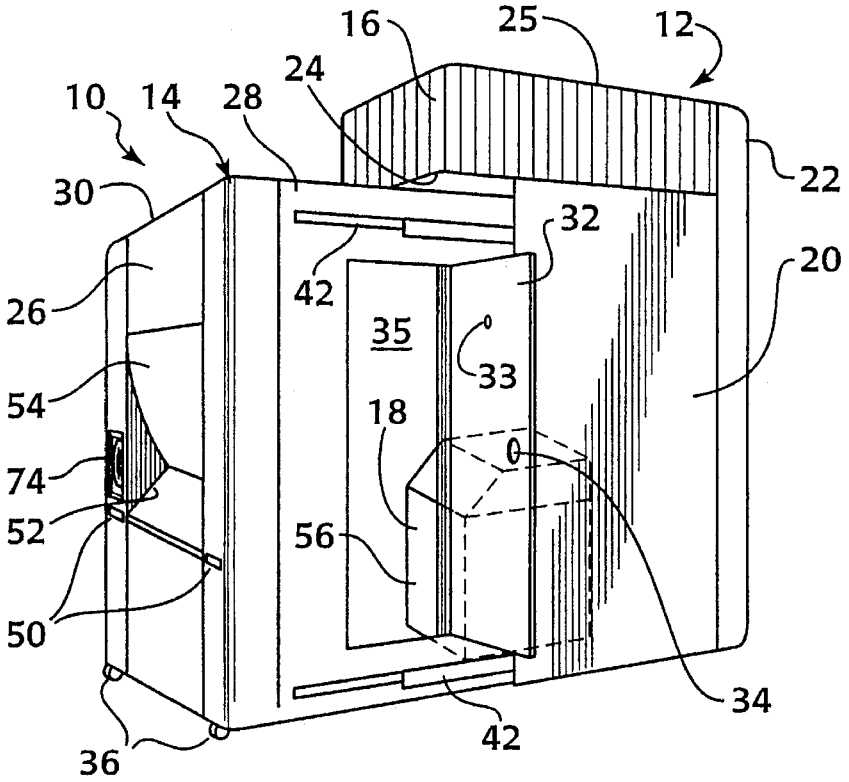
FIG. 1 is a diagrammatic perspective view of the present invention with the front portion in the extended servicing/loading position.

10 front access automatic teller machine enclosure of the present invention
12 hollow parallelepiped-shaped rear portion
14 slightly smaller hollow parallelepiped-shaped front portion
16 rear portion cap-like roof
18 front access automatic teller machine
20 rear portion sidewalls
22 rear portion back wall
24 rear portion open front wall
25 rear portion top wall
26 front portion front wall
28 front portion side walls
30 front portion flat top
32 front portion side wall service door
33 front portion sidewall service door peephole
34 front portion side wall service door pull
35 front portion side wall opening
36 front portion casters
38 front portion L-shaped bracket
40 front portion inner support wall
42 pair of full extension slide members
44 rear portion adjustable leveling feet
46 rear portion corners
48 dead bolt lock arrangement
49 bullet catch
50 front portion front wall recessed hand pulls
52 front portion cutout
54 front portion front wall curved facade
56 automatic teller machine support cabinet
58 lightweight aluminum beams
60 front portion flat top wire mesh grille
62 rear portion top wall vented opening
64 rear portion top wall pipe
rear portion top wall pipe exhaust fan
66 front portion lightweight metallic or wooden quarter round pieces
68 front portion vertically disposed beams
69 rear portion vertically disposed beams
70 front portion lightweight beam
71 front portion front wall security shield
72 front portion front wall security shield piano hinge
74 telephone

DETAILED DESCRIPTION OF THE PREFERRED EMBODIMENT

Figure 2:
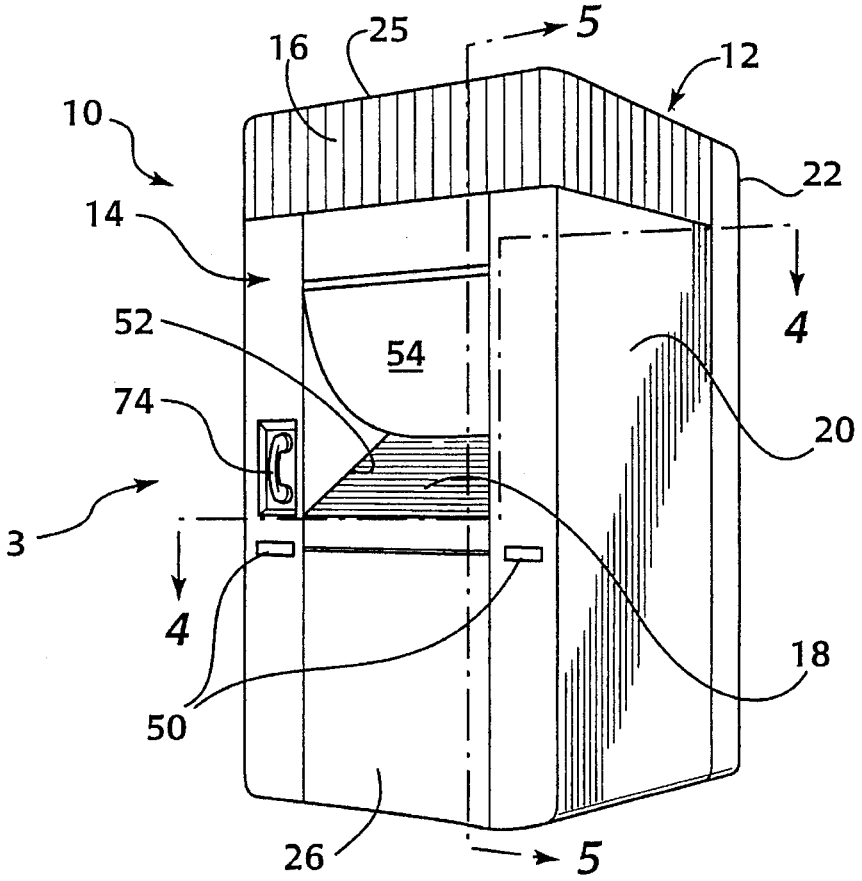
FIG. 2 is a diagrammatic perspective view of the present invention with the front portion in the retracted operating position.
Figure 3:
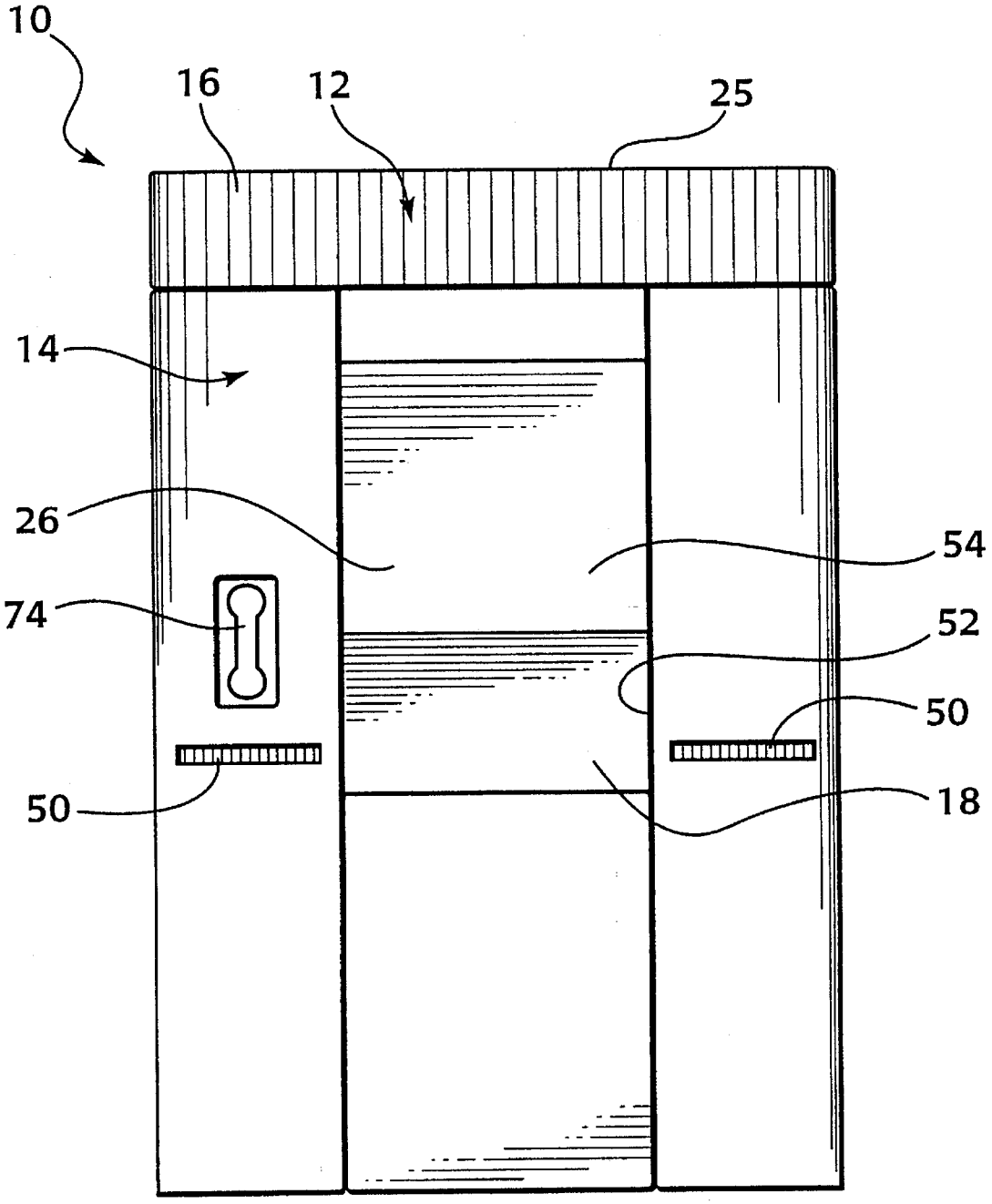
FIG. 3 is a diagrammatic front elevational view taken in the direction of arrow 3 in FIG. 2

Referring now to the figures in which like numerals indicate like parts, and particularly to FIGS. 1–3, the front access automatic teller machine enclosure of the present invention is shown generally at 10 and includes a hollow parallelepiped-shaped rear portion 12 and a slightly smaller hollow parallelepiped-shaped front portion 14 in telescopic communication with the hollow parallelepiped-shaped rear portion 12. A front access automatic teller machine 18 is positioned in the hollow parallelepiped-shaped rear portion 12.

The front access automatic teller machine enclosure 10 weighs approximately 1000 lbs., is modular, and can be kept in a permanent location or can be disassembled and relocated to another location.

The front access automatic teller machine enclosure 10 can be used in various logistical situations. Such situations including, but are not limited to, vestibules and remote standing. Due to the fact that the slightly smaller hollow parallelepiped-shaped front portion 14 telescopes from the hollow parallelepiped-shaped rear portion 12, and that the front access automatic teller machine 18 is positioned in the hollow parallelepiped-shaped rear portion 12, an optimum use for the front access automatic teller machine enclosure would be against a wall.

The front access automatic teller machine enclosure 10 is specifically designed to accommodate a front access loading ATM unit. Such types accommodated by the front access automatic teller machine enclosure 10 include, but not limited to, Interbold ATM units and NCR ATM units.

The hollow parallelepiped-shaped rear portion 12 has a rear portion cap-like roof 16 that is 12 inches high. The front access automatic teller machine 18 is supported within the hollow Parallelepiped-shaped rear portion 12 and is accessible for use by customers from the outside of the slightly smaller hollow parallelepiped-shaped front portion 14, when the slightly smaller hollow parallelepiped-shaped front portion 14 is fully retracted into the hollow parallelepiped-shaped rear portion 12.

When the slightly smaller hollow parallelepiped-shaped front portion 14 is fully retracted into the hollow parallelepiped-shaped rear portion 12, the front access automatic teller machine security enclosure 10 assumes an operating mode.

When the slightly smaller hollow parallelepiped-shaped front portion 14 is fully extended from the hollow parallelepiped-shaped rear portion 12, the front access automatic teller machine security enclosure 10 assumes a servicing/loading mode.

The hollow parallelepiped-shaped rear portion 12 has rear portion sidewalls 20 that extend at right angles from both ends of a rear portion back wall 22. The hollow parallelepiped-shaped rear portion 12 has a rear portion open front wall 24 and a rear portion top wall 25.

The slightly smaller hollow parallelepiped-shaped front portion 14 has a front portion front wall 26, front portion side walls 28, and a front portion flat top 30.

The slightly smaller hollow parallelepiped-shaped front portion 14 is generally similar to the hollow parallelepiped-shaped rear portion 12 but slightly narrower between the rear portion sidewalls 20 of the hollow parallelepiped-shaped rear portion 12 so that the entire slightly smaller hollow parallelepiped-shaped front portion 14 fits within the hollow parallelepiped-shaped rear portion 12 except for the front portion front wall 26 of the slightly smaller hollow parallelepiped-shaped front portion 14 which extends slightly, on both sides, beyond the point where the front portion front wall 26 of the slightly smaller hollow parallelepiped-shaped front portion 14 attaches to the front portion side walls 28 of the slightly smaller hollow parallelepiped-shaped front portion 14.

The part of the front portion front wall 26 of the slightly smaller hollow parallelepiped-shaped front portion 14 which extends slightly, on both sides, beyond the point where the front portion front wall 26 of the slightly smaller hollow parallelepiped-shaped front portion 14 attaches to the front portion side walls 28 of the slightly smaller hollow parallelepiped-shaped front portion 14, abuts the foremost parts of the rear portion sidewalls 20 of the hollow parallelepiped-shaped rear portion 12 to form an entirely closed and secure configuration for the front access automatic teller machine security enclosure 10 when the slightly smaller hollow parallelepiped-shaped front portion 14 is fully retracted into the hollow parallelepiped-shaped rear portion 12.

A front portion side wall service door 32 is attached flush to one of the front portion side walls 28 of the slightly smaller hollow parallelepiped-shaped front portion 14 and closes and opens a front portion side wall opening 35 therein.

The front portion side wall service door 32 of the front portion side wall 28 of the slightly smaller hollow parallelepiped-shaped front portion 14 is 2½ feet wide and 6 feet high and has a front portion sidewall service door peephole 33 and a front portion side wall service door pull 34.

The front portion side wall service door 32 of one of the front portion side walls 28 of the slightly smaller hollow parallelepiped-shaped front portion 14 is so hinged, by a front portion side wall door piano hinge to the one of the front portion side walls 28 of the slightly smaller hollow parallelepiped-shaped front portion 14 so as to open outwardly so that entry into the slightly smaller hollow parallelepiped-shaped front portion 14 is possible when the slightly smaller hollow parallelepiped-shaped front portion 14 is fully extended from the hollow parallelepiped-shaped rear portion 12.

When the front access automatic teller machine 18 is in the servicing/loading mode, that is, the slightly smaller hollow parallelepiped-shaped front portion 14 is fully extended 3 feet from the hollow parallelepiped-shaped rear portion 12, the front portion side wall service door 32 of one of the front portion side walls 28 of the slightly smaller hollow parallelepiped-shaped front portion 14 may be opened and entered by service personal to service and/or load the front access automatic teller machine 18.

Figure 4:
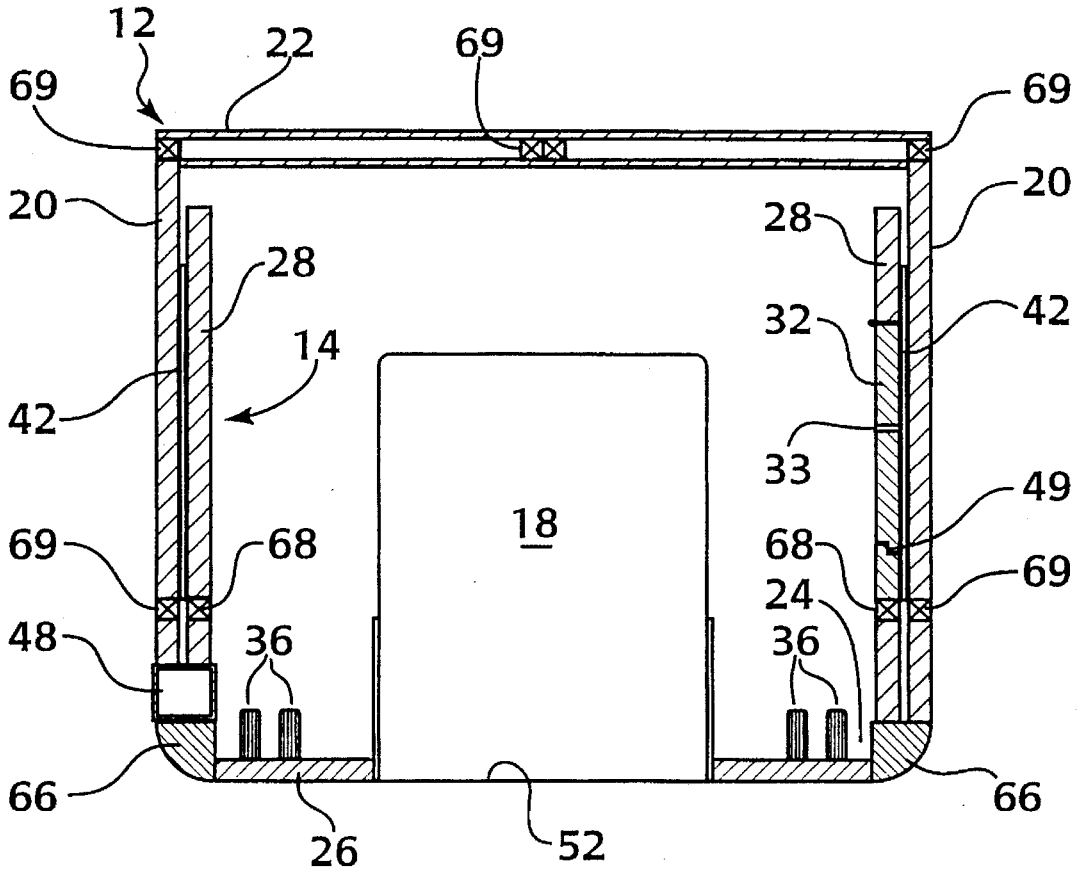
FIG. 4 is a cross sectional view taken along line 4—4 in FIG. 2.
Figure 5:
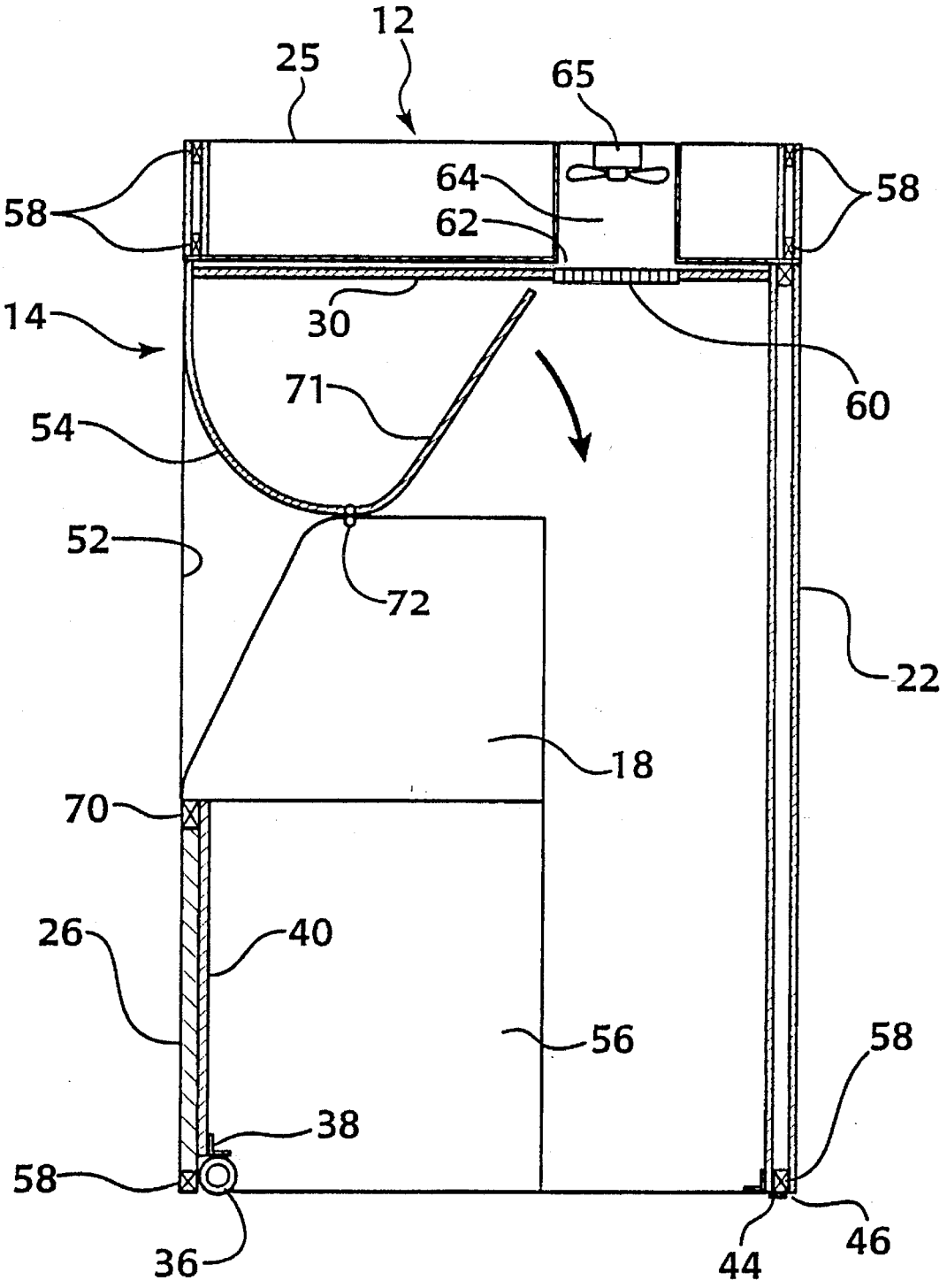
FIG. 5 is a cross sectional view taken along line 5—5 in FIG. 2.

As shown in FIGS. 1, 4 and 5, front portion casters 36 are mounted on a front portion L-shaped bracket 38, which in turn is bolted to a front portion inner support wall 40, which in turn is attached to a lateral frame (not shown), which in turn is attached to the bottom of the front portion front wall 26 of the slightly smaller hollow parallelepiped-shaped front portion 14.

As shown in FIGS. 1 and 4, a pair of full extension slide members 42 are attached to the top and bottom of the inside of each of the rear portion sidewalls 20 of the hollow parallelepiped-shaped rear portion 12 and are matingly attached to the top and bottom of the outside of each of the front portion side walls 28 of the slightly smaller hollow parallelepiped-shaped front portion 14, on both sides of the front access automatic teller machine enclosure 10.

The pair of full extension slide members 42 of the front access automatic teller machine enclosure 10 are heavy duty and can carry 250 lbs per pair and thereby permit smooth movement of the slightly smaller hollow parallelepiped-shaped front portion 14 into and out of the hollow parallelepiped-shaped rear portion 12. The pair of full extension slide members 42 of the front access automatic teller machine enclosure 10 may be ¾ inch Grant type, but is not limited to it.

As shown in FIG. 5, the hollow parallelepiped-shaped rear portion 12 is mounted on rear portion adjustable leveling feet 44 and may also be bolted to a surface by screw bolts (not shown) passed through rear portion corners 46.

Flooring (not shown) may be used in either or both of the slightly smaller hollow parallelepiped-shaped front portion 14 and the hollow parallelepiped-shaped rear portion 12, but may add unnecessary weight to the front access automatic teller machine enclosure 10.

When the front access automatic teller machine enclosure 10 is constructed for interior use, the walls of the front access automatic teller machine enclosure 10 are 2½ inches thick and preferably constructed from wood and/or FORMICA(TM). Laminate composite materials have sufficient strength to withstand numerous moves of the front access automatic teller machine enclosure 10 and the forces exerted by the extension and retraction of the slightly smaller hollow parallelepiped-shaped front portion 14, while being light in weight and strong enough to resist attempts to enter the front access automatic teller machine enclosure 10 by unauthorized people. The slightly smaller hollow parallelepiped-shaped front portion 14, that is accessible by the public, may require additional strengthening.

When the front access automatic teller machine enclosure 10 is constructed for exterior use, the walls of the front access automatic teller machine enclosure 10 are 1¼ inches thick and preferably made metal panels that are structurally ribbed and insulated.

As shown in FIG. 4, to prevent unauthorized entry into or movement of the front access automatic teller machine enclosure 10, the slightly smaller hollow parallelepiped-shaped front portion 14 is secured to the hollow parallelepiped-shaped rear portion 12 by a dead bolt lock arrangement 48. The dead bolt lock arrangement 48 may be the Adamsrite type, but is not limited to it. The dead bolt lock arrangement 48 is attached within one of the extensions of the front portion front wall 26 of the slightly smaller hollow parallelepiped-shaped front portion 14 and engages a clasp (not shown) or the like attached to or within one of the rear portion sidewalls 20 of the hollow parallelepiped-shaped rear portion 12, adjacent to the front portion front wall 26 of the slightly smaller hollow parallelepiped-shaped front portion 14.

The dead bolt lock arrangement 48 requires a key (not shown) to enable the slightly smaller hollow parallelepiped-shaped front portion 14 to be moved relative to the hollow parallelepiped-shaped rear portion 12.

A bullet catch 49 maintains the front portion side wall service door 32 of one of the front portion side walls 28 of the slightly smaller hollow parallelepiped-shaped front portion 14 closed until unlatched.

As shown in FIGS. 1–3, front portion front wall recessed hand pulls 50 are, 16 inches long, and are attached at a convenient height on the front portion front wall 26 of the slightly smaller hollow parallelepiped-shaped front portion 14 adjacent the front access automatic teller machine 18 to conveniently permit one person to pull out the slightly smaller hollow Parallelepiped-shaped front portion 14 from the hollow parallelepiped-shaped rear portion 12.

When the front access automatic teller machine enclosure 10 is in the operating mode, that is, the slightly smaller hollow parallelepiped-shaped front portion 14 is fully retracted in the hollow parallelepiped-shaped rear portion 12, the approximate dimensions are 6 feet wide, 5 feet deep, and 8 feet high.

When the front access automatic teller machine enclosure 10 is in the servicing/loading mode, that is, the slightly smaller hollow parallelepiped-shaped front portion 14 is fully extended from the hollow parallelepiped-shaped rear portion 12, the approximate dimensions are 6 feet wide, 8 feet deep, and 8 feet high. With such dimensions, it is possible for three people to service the front access automatic teller machine 18 from inside the front access automatic teller machine enclosure 10.

Electrical power that is supplied to the front access automatic teller machine enclosure 10 operates the front access automatic teller machine 18, may also be used for interior lighting and for supplying power to service equipment.

As shown in FIGS. 1–5, the front portion front wall 26 of the slightly smaller hollow parallelepiped-shaped front portion 14 has a front portion cutout 52 that is 21 inches wide and 30 ⅛ inches high and is 25½ inches from the bottom of the front portion front wall 26 of the slightly smaller hollow parallelepiped-shaped front portion 14.

When the front access automatic teller machine enclosure 10 is in the operating mode, the front access automatic teller machine 18 enters the front portion cutout 52 of the front portion front wall 26 of the slightly smaller hollow parallelepiped-shaped front portion 14, making the front access automatic teller machine 18 accessible by the customer.

The front portion front wall 26 of the slightly smaller hollow parallelepiped-shaped front portion 14 further has a front portion front wall curved facade 54 that is 28⅜ inches high, is disposed above, and curves 16 inches into the front portion cutout 52 of the front portion front wall 26 of the slightly smaller hollow parallelepiped-shaped front portion 14.

As shown in FIG. 5, a front portion front wall security shield 71 is used to cover, and thereby fully secures, the front portion cutout 52 of the front portion front wall 26 of the slightly smaller hollow parallelepiped-shaped front portion 14, when the slightly smaller hollow parallelepiped-shaped front portion 14 is extended and the front access automatic teller machine enclosure 10 is in the servicing/loading mode.

The front portion front wall security shield 71 of the front portion front wall 26 of the slightly smaller hollow parallelepiped-shaped front portion 14 may either be pivoted down from the bottom of the front portion front wall curved facade 54 of the front portion front wall 26 of the slightly smaller hollow parallelepiped-shaped front portion 14, by a front portion front wall security shield piano hinge 72, or pulled down from the inside of the front portion front wall curved facade 54 of the front portion front wall 26 of the slightly smaller hollow parallelepiped-shaped front portion 14, by tracks (not shown).

In either case, the front portion front wall security shield 71 of the front portion front wall 26 of the slightly smaller hollow parallelepiped-shaped front portion 14 is locked in place by a pair of steel pegs (not shown).

As shown in FIGS. 4 and 5, the front access automatic teller machine 18 is positioned in the hollow parallelepiped-shaped rear portion 12 and is supported therein by applicable internal supports that support the weight of the front access automatic teller machine 18. The applicable internal supports may consist of an automatic teller machine support cabinet 56 with rearwardly and/or sidewardly facing shelves (not shown) for storing records (not shown) and/or test equipment (not shown), as well as providing support for the front access automatic teller machine 18.

Support for the outer walls of the front access automatic teller machine enclosure 10 is provided by lightweight aluminum beams 58 attached horizontally to the inner walls of the front access automatic teller machine enclosure 10.

As shown in FIG. 5, the front portion flat top 30 of the slightly smaller hollow parallelepiped-shaped front portion 14 contains a front portion flat top wire mesh grille 60 that is immediately beneath a rear portion top wall vented opening 62 in the rear portion top 25 of the hollow parallelepiped-shaped rear portion 12.

A rear portion top wall pipe 64 extends completely through the rear portion top 25 of the hollow parallelepiped-shaped rear portion 12, permitting heat generated by the front access automatic teller machine 18 to escape from the front access automatic teller machine enclosure 10.

A rear portion top wall pipe exhaust fan 65 is continuous and is disposed in the rear portion top wall pipe 64 of the rear portion top wall 25 of the hollow parallelepiped-shaped rear portion 12 to facilitate the escape of the heat generated by the front access automatic teller machine 18.

As shown in FIG. 4, front portion lightweight metallic or wooden quarter round pieces 66, with a 6 inch radii, may be attached where the front portion front wall 26 of the slightly smaller hollow parallelepiped-shaped front portion 14 connects to the front portion side walls 28 of the slightly smaller hollow parallelepiped-shaped front portion 14, such as by bolts (not shown) and/or brackets (not shown), to provide added support to the slightly smaller hollow parallelepiped-shaped front portion 14 and to provide a finished appearance.

Front portion vertically disposed beams 68 are provided in the slightly smaller hollow parallelepiped-shaped front portion 14 for additional support.

Rear portion vertically disposed beams 69 are provided in the hollow parallelepiped-shaped rear portion 12 for additional support and for connecting the rear portion back wall 22 of the hollow parallelepiped-shaped rear portion 12 to the rear portion sidewalls 20 of the hollow parallelepiped-shaped rear portion 12.

As shown in FIG. 5, the front portion front wall 26 of the slightly smaller hollow parallelepiped-shaped front portion 14 contains a front portion lightweight beam 70 that is connected between the front portion lightweight metallic or wooden quarter round pieces 66 of the slightly smaller hollow parallelepiped-shaped front portion 14 for added support.

As shown in FIGS. 1–3, a telephone 74 is recessed at a convenient height in the front portion front wall 26 of the slightly smaller hollow parallelepiped-shaped front portion 14, to one side of the front access automatic teller machine 18.

It will be understood that each of the elements described above, or two or more together, may also find a useful application in other types of constructions differing from the types described above.

While the invention has been illustrated and described as embodied in a front access automatic teller machine enclosure, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A front access automatic teller machine security enclosure, comprising:

a) a hollow parallelepiped-shaped rear portion having a top with an aperture, a pair of side walls, a back wall, a bottom, and a substantially open front wall;

b) a hollow parallelepiped-shaped front portion being smaller than said hollow parallelepiped-shaped rear portion and being in telescopic communication with said hollow parallelepiped-shaped rear portion through said substantially open front wall of said hollow parallelepiped-shaped rear portion, said hollow parallelepiped-shaped front portion having a top with an aperture, a pair of side walls one of which having an aperture, an open back wall, a bottom, and a front wall with an aperture, said hollow parallelepiped-shaped front portion having an extended position where said hollow parallelepiped-shaped front portion is fully extended from said hollow parallelepiped-shaped rear portion and a front access automatic teller machine, that is disposed in said hollow parallelepiped-shaped rear portion, does not enter said aperture of said front wall of said hollow parallelepiped-shaped front portion and a retracted position where said hollow parallelepiped-shaped front portion is fully retracted into said hollow parallelepiped-shaped rear portion and the front access automatic teller machine, that is disposed in said hollow parallelepiped-shaped rear portion, enters said aperture of said front wall of said hollow parallelepiped-shaped front portion;

c) a service door hingedly mounted flush to said one of said pair of side walls having said aperture of said hollow parallelepiped-shaped front portion, said service door of said one of said pair of side walls opening and closing said aperture of said one of said pair of side walls of said hollow parallelepiped-shaped front portion, so that when said hollow parallelepiped-shaped front portion is in said extended position said service door of said one of said pair of side walls of said hollow parallelepiped-shaped front portion can be opened and the front access automatic teller machine, that is disposed in said hollow parallelepiped-shaped rear portion, can be serviced and when said hollow parallelepiped-shaped front portion is in said retracted position said service door of said one of said pair of side walls of said hollow parallelepiped-shaped front portion can not be opened; and d) a security shield movably mounted to said front wall of said hollow parallelepiped-shaped front portion and opening and closing said aperture of said front wall of said hollow parallelepiped-shaped front portion, so that when said hollow parallelepiped-shaped front portion is in said retracted position said security shield of said front wall of said hollow parallelepiped-shaped front portion is clear of said aperture of said front wall of said hollow parallelepiped-shaped front portion and the front access automatic teller machine, that is disposed in said hollow parallelepiped-shaped rear portion, enters said aperture of said front wall of said hollow parallelepiped-shaped front portion and is accessible by a customer and when said hollow parallelepiped-shaped front portion is in said extended position said security shield of said front wall of said hollow parallelepiped-shaped front portion can cover said aperture of said front wall of said hollow parallelepiped-shaped front portion and the front access automatic teller machine, that is disposed in said hollow parallelepiped-shaped rear portion, does not enter said aperture of said front wall of said hollow parallelepiped-shaped front portion and is not accessible by a customer, further comprising a wire mesh grille that is disposed in said aperture of said top of said hollow parallelepiped-shaped front portion immediately beneath said aperture of said top of said hollow parallelepiped-shaped rear portion, a pipe that extends completely through said aperture of said top of said hollow parallelepiped-shaped rear portion, and an exhaust fan that is disposed in said pipe, so that heat generated by the front access automatic teller machine can escape from said front access automatic teller machine security enclosure.

2.The enclosure as defined in claim 1, wherein said hollow parallelepiped-shaped rear portion and said hollow parallelepiped-shaped front portion are modular, so that said automatic teller machine security enclosure can be disassembled and relocated to another location.

3. The enclosure as defined in claim 1, wherein said hollow parallelepiped-shaped front portion is narrower than said hollow parallelepiped-shaped rear portion, so that said hollow parallelepiped-shaped front portion fits within said hollow parallelepiped-shaped rear portion except for said front wall of said hollow parallelepiped-shaped front portion which extends on both sides beyond the point where said front wall of said hollow parallelepiped-shaped front portion attaches to said pair of side walls of said hollow parallelepiped-shaped front portion.

4. The enclosure as defined in claim 3, wherein said front wall of said hollow parallelepiped-shaped front portion which extends on both sides beyond the point where said front wall of said hollow parallelepiped-shaped front portion attaches to said pair of side walls of said hollow parallelepiped-shaped front portion abuts the foremost parts of said pair of sidewalls of said hollow parallelepiped-shaped rear portion, so that when said hollow parallelepiped-shaped front portion is fully retracted into said hollow parallelepiped-shaped rear portion an entirely closed and secure configuration for said front access automatic teller machine security enclosure is provided.

5. The enclosure as defined in claim 1, wherein said service door of said one of said pair of side walls of said hollow parallelepiped-shaped front portion has a peep hole and a door pull, so that opening of said service door of said one of said pair of side walls of said hollow parallelepiped-shaped front portion is facilitated.

6. The enclosure as defined in claim 1; further comprising casters that are mounted on a L-shaped bracket which is bolted to an inner support wall, so that said hollow parallelepiped-shaped front portion can be readily moved into and out of said hollow parallelepiped-shaped rear portion.

7. The enclosure as defined in claim 6; further comprising a pair of full extension slide members that are attached to the top and bottom of the inside of each of said pair of sidewalls of said hollow parallelepiped-shaped rear portion and are matingly attached to the top and bottom of the outside of each of said pair of side walls of said hollow parallelepiped-shaped front portion, so that said hollow parallelepiped-shaped front portion can be smoothly moved into and out of said hollow parallelepiped-shaped rear portion.

8. The enclosure as defined in claim 1; further comprising adjustable leveling feet that are mounted to the rear of the outside of the bottom of said hollow parallelepiped-shaped rear portion, so that said front access automatic teller machine security enclosure can be properly leveled.

9. The enclosure as defined in claim 1, wherein the exterior of said front access automatic teller machine security enclosure is a material selected from the group consisting of wood, laminate composite material, and structurally ribbed and insulated metal, so that numerous moves of said front access automatic teller machine security enclosure and the forces exerted by the extension and retraction of said hollow parallelepiped-shaped front portion can be withstood while resisting attempts to enter said front access automatic teller machine security enclosure by unauthorized people.

10. The enclosure as defined in claim 1; further comprising a dead bolt lock arrangement to secure said hollow parallelepiped-shaped front portion to said hollow parallelepiped-shaped rear portion, so that unauthorized entry into said front access automatic teller machine security enclosure is prevented.

11. The enclosure as defined in claim 10, wherein said dead bolt lock arrangement includes a dead bolt that is attached within an extension of said front wall of said hollow parallelepiped-shaped front portion to be capable of engaging a clasp attached to one of said pair of sidewalls of said hollow parallelepiped-shaped rear portion adjacent to said front wall of said hollow parallelepiped-shaped front portion.

12. The enclosure as defined in claim 1; further comprising a bullet catch, so that said service door of one of said pair of side walls of said hollow parallelepiped-shaped front portion is maintained closed until unlatched.

13. The enclosure as defined in claim 1; further comprising recessed hand pulls that are attached on said front wall of said hollow parallelepiped-shaped front portion adjacent said aperture of said front wall of said hollow parallelepiped-shaped front portion, so that one person can conveniently pull out said hollow parallelepiped-shaped front portion from said hollow parallelepiped-shaped rear portion.

14. The enclosure as defined in claim 1, wherein said front wall of said hollow parallelepiped-shaped front portion further has a curved facade that is disposed above, and curves into, said aperture of said front wall of said hollow parallelepiped-shaped front portion.

15. The enclosure as defined in claim 14, wherein said security shield of said front wall of said hollow parallelepiped-shaped front portion is movable relative to said curved facade of said front wall of said hollow parallelepiped-shaped front portion by means selected from the group consisting of pulled down from the inside of said curved facade of said front wall of said hollow parallelepiped-shaped front portion, and pivoted down from the bottom of said curved facade of said front wall of said hollow parallelepiped-shaped front portion by a piano hinge, so that said aperture of said front wall of said hollow parallelepiped-shaped front portion can be conveniently closed and opened.

16. The enclosure as defined in claim 1; further comprising a cabinet that is disposed in said hollow parallelepiped-shaped rear portion, so that the front access automatic teller machine can be supported thereon.

17. The enclosure as defined in claim 1; further comprising vertically disposed quarter round pieces that are disposed where with said front wall of said hollow parallelepiped-shaped front portion connects to said pair of side walls of said hollow parallelepiped-shaped front portion, so that said front access automatic teller machine security enclosure has added support and a finished appearance.

18. The enclosure as defined in claim 1; further comprising a telephone that is recessed in said front wall of said hollow parallelepiped-shaped front portion to one side of the front access automatic teller machine.

* * * * *